US008113004B2

(12) United States Patent
Carlisle et al.

(10) Patent No.: US 8,113,004 B2
(45) Date of Patent: Feb. 14, 2012

(54) WALL ELEMENT FOR USE IN COMBUSTION APPARATUS

(75) Inventors: Michael Lawrence Carlisle, Derby (GB); Ian Murray Garry, Leicestershire (GB)

(73) Assignee: Rolls-Royce, PLC (GB)

( * ) Notice: Subject to any disclaimer, the term of this patent is extended or adjusted under 35 U.S.C. 154(b) by 652 days.

(21) Appl. No.: 12/243,002

(22) Filed: Oct. 1, 2008

(65) Prior Publication Data

US 2009/0100838 A1 Apr. 23, 2009

(30) Foreign Application Priority Data

Oct. 23, 2007 (GB) ..... 0720662.6

(51) Int. Cl.
*F23R 3/00* (2006.01)

(52) U.S. Cl. ..... 60/752; 60/755

(58) Field of Classification Search ..... 60/752–760, 60/800; 110/336–340; 431/350, 351, 353; 165/81, 154
See application file for complete search history.

(56) References Cited

U.S. PATENT DOCUMENTS

| | | | | |
|---|---|---|---|---|
| 2,617,255 | A * | 11/1952 | Niehus | 60/757 |
| 2,916,878 | A | 12/1959 | Wirt | |
| 2,933,895 | A | 4/1960 | Cheeseman | |
| 3,295,280 | A | 1/1967 | Kettner | |
| 4,030,875 | A | 6/1977 | Grondahl et al. | |
| 4,315,405 | A | 2/1982 | Pidcock et al. | |
| 4,652,476 | A | 3/1987 | Kromrey | |
| 5,000,005 | A * | 3/1991 | Kwan et al. | 60/757 |
| 5,050,385 | A | 9/1991 | Hirose et al. | |
| 5,137,586 | A | 8/1992 | Klink | |
| 5,331,816 | A | 7/1994 | Able et al. | |
| 5,341,769 | A * | 8/1994 | Ueno et al. | 122/367.3 |
| 5,405,261 | A | 4/1995 | Scraggs et al. | |
| 5,449,422 | A | 9/1995 | Pflanz et al. | |
| 5,553,455 | A | 9/1996 | Craig et al. | |
| 5,577,379 | A | 11/1996 | Johnson | |
| 5,709,919 | A | 1/1998 | Kranzmann et al. | |
| 5,782,294 | A | 7/1998 | Froemming et al. | |
| 5,799,491 | A * | 9/1998 | Bell et al. | 60/752 |
| 5,957,067 | A | 9/1999 | Dobbeling et al. | |
| 6,050,081 | A | 4/2000 | Jansen et al. | |
| 6,174,389 | B1 | 1/2001 | Mann | |
| 6,182,442 | B1 | 2/2001 | Schmidt et al. | |
| 6,199,371 | B1 * | 3/2001 | Brewer et al. | 60/766 |
| 6,351,949 | B1 | 3/2002 | Rice et al. | |
| 6,470,685 | B2 * | 10/2002 | Pidcock et al. | 60/752 |
| 6,770,325 | B2 | 8/2004 | Troczynski et al. | |
| 6,901,757 | B2 * | 6/2005 | Gerendas | 60/752 |
| 6,931,831 | B2 | 8/2005 | Jansen | |
| 7,024,862 | B2 | 4/2006 | Miyake et al. | |
| 2002/0184892 | A1 | 12/2002 | Calvez et al. | |

(Continued)

FOREIGN PATENT DOCUMENTS

DE 10136196 A1 2/2003

(Continued)

*Primary Examiner* — Ehud Gartenberg
*Assistant Examiner* — Lorne Meade
(74) *Attorney, Agent, or Firm* — McCormick, Paulding & Huber LLP

(57) ABSTRACT

A tile for use as part of an inner wall of a gas turbine engine combustor, the tile being provided with deformable cooling pedestals extending into a space between the tile and the outer wall. The pedestals are deformed in contact with the outer wall of the combustor.

10 Claims, 5 Drawing Sheets

U.S. PATENT DOCUMENTS

| | | | |
|---|---|---|---|
| 2003/0056516 | A1 | 3/2003 | Hadder |
| 2003/0079475 | A1 | 5/2003 | Schmahl et al. |
| 2004/0110041 | A1 | 6/2004 | Merrill et al. |
| 2004/0118127 | A1 | 6/2004 | Mitchell et al. |
| 2005/0034399 | A1 | 2/2005 | Pidcock et al. |
| 2005/0238859 | A1 | 10/2005 | Uchimaru et al. |
| 2006/0242914 | A1 | 11/2006 | Stephansky et al. |
| 2007/0028592 | A1 | 2/2007 | Grote et al. |
| 2007/0028620 | A1 | 2/2007 | McMasters et al. |
| 2007/0107710 | A1 | 5/2007 | DeSousa et al. |
| 2007/0234730 | A1 | 10/2007 | Markham et al. |
| 2007/0246149 | A1 | 10/2007 | Millard et al. |
| 2007/0289307 | A1 | 12/2007 | Grote et al. |
| 2008/0099465 | A1 | 5/2008 | Myers et al. |

FOREIGN PATENT DOCUMENTS

| | | | |
|---|---|---|---|
| EP | 1734136 | | 12/2006 |
| EP | 1734136 | A2 | 12/2006 |
| EP | 1741981 | A1 | 1/2007 |
| GB | 1503921 | | 3/1978 |
| GB | 2148949 | A | 10/1984 |
| GB | 2353589 | A | 2/2001 |
| GB | 2361304 | A | 10/2001 |
| JP | 8021687 | A | 7/1994 |

* cited by examiner

WALL ELEMENT FOR USE IN COMBUSTION APPARATUS

CROSS REFERENCE TO RELATED APPLICATION

This application is entitled to the benefit of British Patent Application No. GB 0720662.6, filed on Oct. 23, 2007.

FIELD OF THE INVENTION

This invention relates to combustion apparatus for a gas turbine engine. More particularly, the invention relates to a wall element for use in a wall structure of such a combustion apparatus.

BACKGROUND OF THE INVENTION

A typical gas turbine engine combustor includes a generally annular chamber having a plurality of fuel injectors at an upstream head end. Combustion air is provided through the head and in addition through primary and intermediate mixing ports provided in the combustor walls downstream of the fuel injectors.

In order to improve the thrust and fuel consumption of gas turbine engines, i.e., the thermal efficiency, it is necessary to use high compressor pressure and combustion temperatures. This results in the combustion chamber experiencing high temperatures and there is a need to provide effective cooling of the combustion chamber walls. Various cooling methods have been proposed including the provision of a double walled combustion chamber whereby cooling air is directed into a gap between spaced outer and inner walls, thus cooling the inner wall. This air is then exhausted into the combustion chamber through apertures in the inner wall. The exhausted air forms a cooling film, which flows along the hot, internal side of the inner wall, thus preventing the inner wall from overheating.

The inner wall may comprise a number of heat resistant tiles. The tiles are generally rectangular in shape and are bowed to conform to the overall shape of the annular combustor wall. The tiles are conventionally longer in the circumferential direction of the combustor than in the axial direction.

It is known to provide pedestals, which extend from an outer surface of the tile towards the inner surface of the outer wall. The pedestals increase the surface area of the tile and facilitate heat removal from the tile "hot" side by primarily convection as cooling air passes between the pedestals and secondly by conduction from the pedestal to the outer "cold" wall of the combustor where the pedestal and wall contact.

The tiles and outer "cold" wall of the combustor are typically of cast construction. Cast components generally cannot be produced to very high tolerances and this inevitably results in gaps between some of the pedestals and the outer wall. Indeed, the pedestals, are typically arranged to provide a gap between the pedestal and the outer wall to prevent damage to the wall or tile caused by differences in thermal expansion between these two components.

Such a gap is undesirable since it reduces the effect of heat removal by conduction and additionally the effect of heat removal by convection since the air can pass over the pedestal tip rather than across the pedestal surface.

SUMMARY OF THE INVENTION

It is an object of the present invention to seek to address this and other problems.

According to a first aspect of the invention, there is provided a wall element for use as part of an inner wall of a gas turbine engine combustor wall structure including inner and outer walls defining a space therebetween, the wall element being provided with deformable cooling pedestals extending into the space and which on contact with the outer wall deform against the outer wall of the wall structure.

Preferably, the wall element further comprises fastening elements for securing the wall element to the outer wall.

Preferably, the pedestals are at an angle other than 90° to the inner wall.

Preferably, the wall element includes a body portion for providing the inner wall of the combustor wall structure and elongate edge portions projecting from the body portion towards the outer wall of the combustor wall structure in use and wherein the pedestal means are provided on the body portion which project in the same direction as and extend beyond the edge portions.

The pedestals may have the form of a helical or omega spring.

Preferably, the wall element is generally rectangular and includes axial and circumferential edges, the axial edges being generally oriented in an axial direction of the gas turbine engine combustor in use and the circumferential edges being generally oriented in a circumferential direction of the gas turbine engine combustor in use.

Seal means may be provided on or near the axial edges of the wall element. Seal means may be provided also on or near the circumferential edges of the wall element.

The wall element may be for use in a backplate region of a combustor. The wall element may have generally sector shaped, including spaced radial edges and spaced circumferential edges.

According to a second aspect of the invention there is provided a wall structure for a gas turbine engine combustor, the wall structure including inner and outer walls defining a space therebetween, wherein the inner wall includes at least one wall element according to any preceding claim.

Preferably, the wall structure includes a plurality of wall elements, and edges of the wall elements at least partially overlap.

BRIEF DESCRIPTION OF THE DRAWINGS

FIG. 4 is a diagrammatic cross-section of a wall element in accordance with the invention, while

DETAILED DESCRIPTION OF THE PREFERRED EMBODIMENTS

Figure 1:
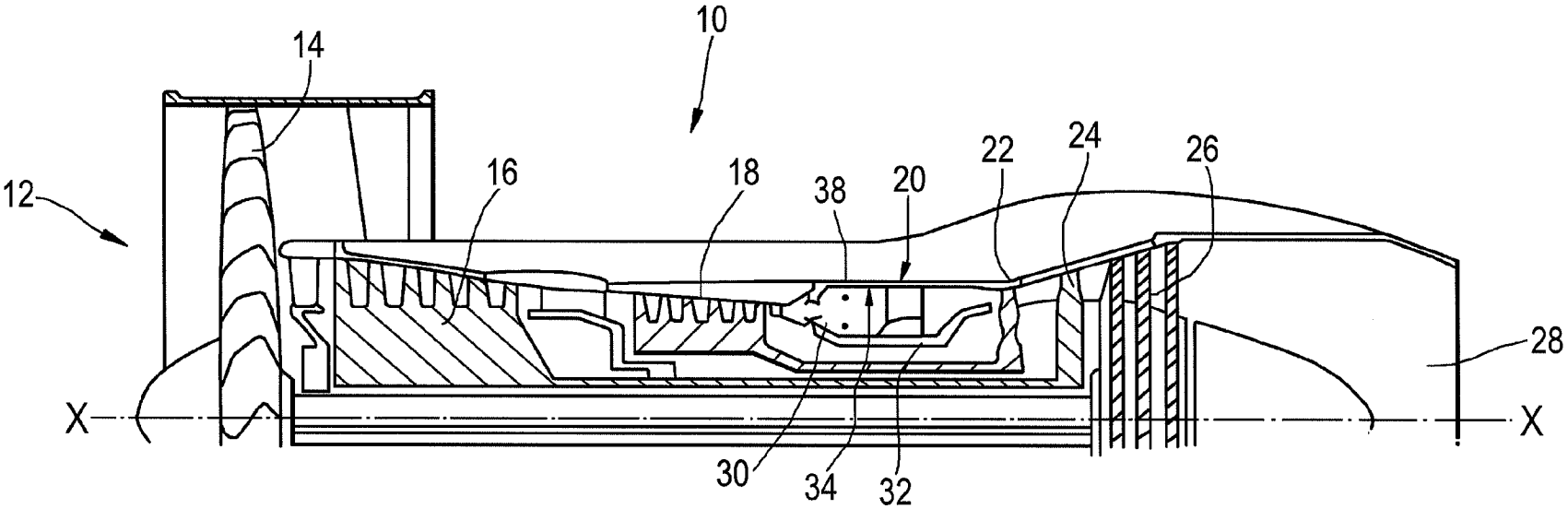
FIG. 1 is a schematic diagram of a ducted fan gas turbine engine having an annular combustor.

With reference to FIG. 1, a ducted fan gas turbine engine generally indicated at 10 comprises, in axial flow series, an air intake 12, a propulsive fan 14, an intermediate pressure compressor 16, a high pressure compressor 18, combustion equipment 20, a high pressure turbine 22, an intermediate pressure turbine 24, a low pressure turbine 26 and an exhaust nozzle 28.

The gas turbine works in the conventional manner so that air entering the intake 12 is accelerated by the fan 14 to produce two air flows, a first air flow into the intermediate pressure compressor 16 and a second airflow which provides propulsive thrust. The intermediate pressure compressor 16 compresses the air flow directing it into the high pressure compressor 18 where further compression takes place.

The compressed air exhausted from the high pressure compressor 18 is directed into the combustion equipment 20 where it is mixed with fuel and the mixture combusted. The resultant hot combustion products then expand through and thereby drive the high, intermediate and low pressure turbines 22, 24 and 26 respectively before being exhausted through the nozzle 28 to provide additional propulsive thrust. The high, intermediate and low pressure turbines 22, 24 and 26 respectively drive the high and intermediate pressure compressors 16 and 18 and the fan 14 by suitably interconnecting shafts (not shown).

The combustion equipment 20 includes an annular combustor 30 having radially inner and outer wall structures 32 and 34 respectively. Fuel is directed into the combustor 30 through a number of fuel nozzles (not shown) located at the upstream end of the combustor 30. The fuel nozzles are circumferentially spaced around the engine 10 and serve to spray fuel into air derived from the high pressure compressor 18. The resultant fuel is then combusted in the combustor 30.

The combustion process which takes place within the combustor 30 naturally generates a large amount of heat. Temperatures within the combustor may be between 1,850K and 2,600K. It is necessary therefore to arrange that the inner and outer wall structures 32 and 34 are capable of withstanding these temperatures while functioning in a normal manner. The radially inner wall structure can be seen more clearly in FIG. 2.

Figure 2:
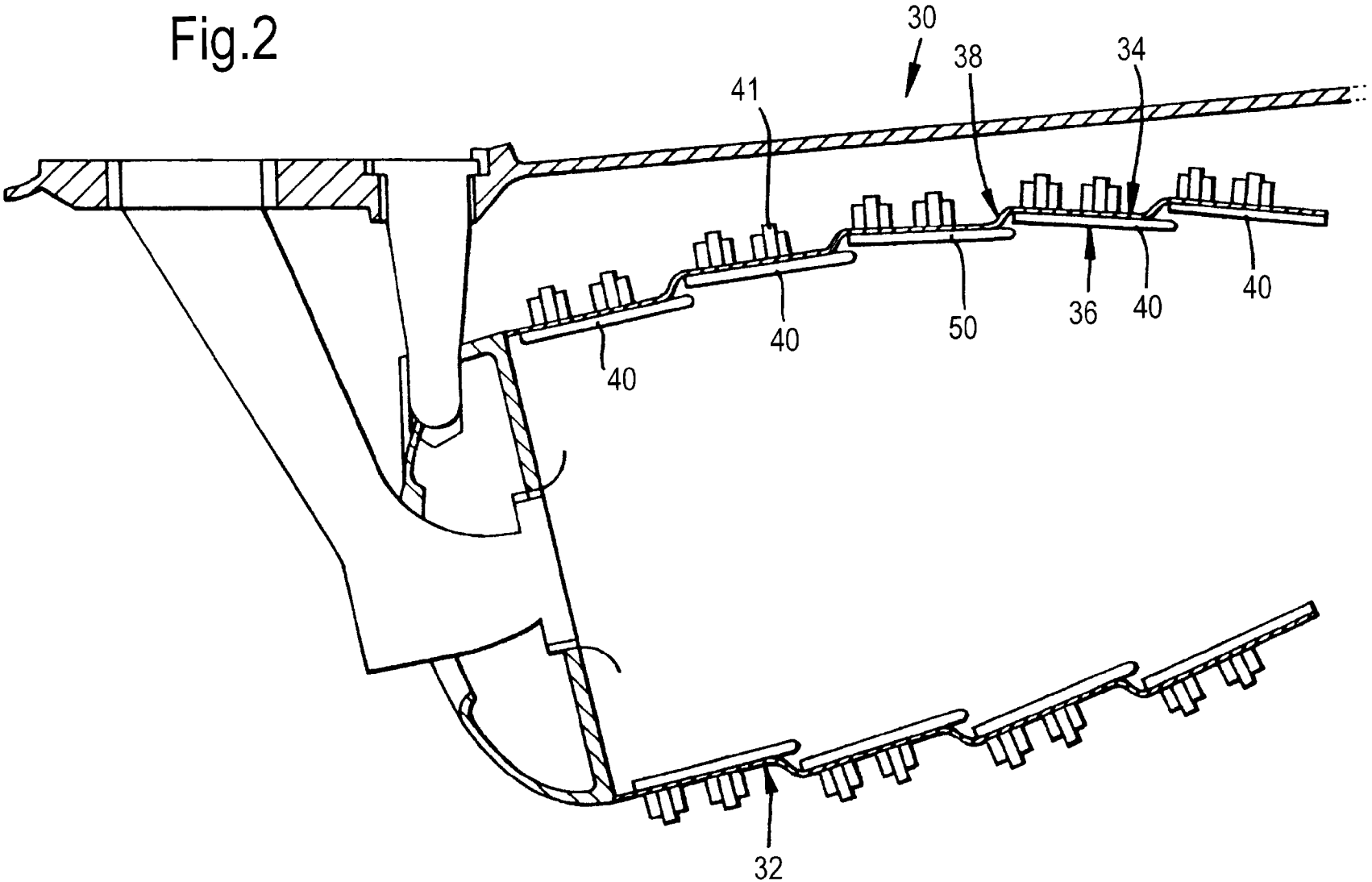
FIG. 2 is a diagrammatic cross-section of an annular combustor.

Referring to FIG. 2, the wall structure includes an inner wall 36 and an outer wall 38. The inner wall comprises a plurality of discrete tiles 40, which are all of substantially the same rectangular configuration and positioned adjacent each other. The majority of the tiles 40 are arranged to be equidistant from the outer wall 38, and the tiles are arranged such that a downstream edge of each tile 40 overlaps an upstream edge of an adjacent tile 40. Each tile 40 is provided with integral studs 41 which facilitate its attachment to the outer wall 38.

The air temperature outside the combustor 30 is about 800K to 900K. Feed holes (not shown in FIG. 2) are provided in the outer wall 38 such that high pressure, relatively cool air flows into a space 50 between the tiles 40 and the outer wall 38. Effusion holes are provided within the tiles 40 such that the cooling air flows through the tiles 40 and forms a cool air film over the hot, internal surface of the tiles 40. This air film prevents the tiles 40 from overheating.

Figure 3:
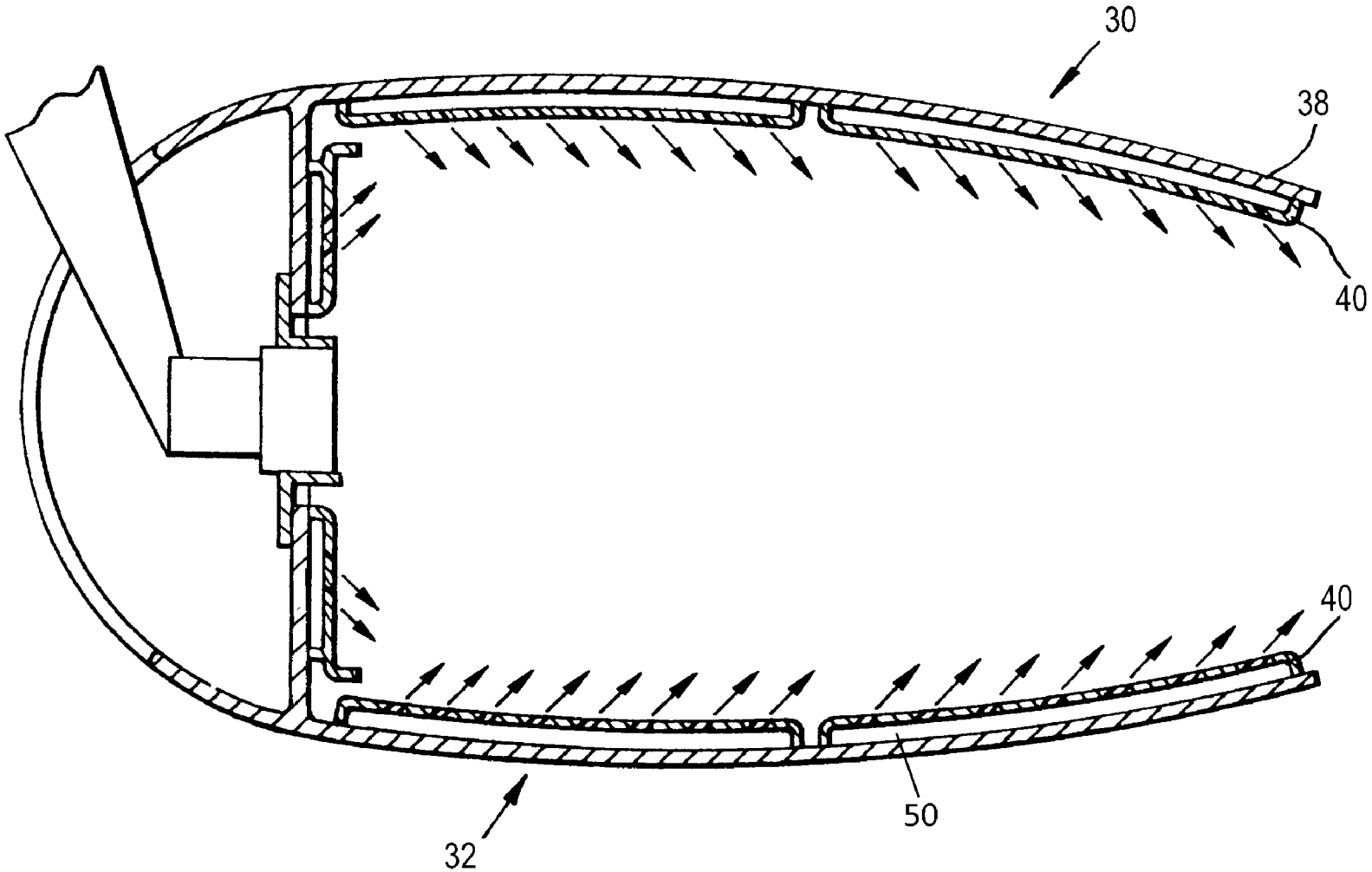
FIG. 3 is a diagrammatic cross-section of a further annular combustor.

The cooling film flows over the tiles 40 in the general direction of fluid flow through the combustor 30, i.e. to the right as shown in FIG. 2 and 3.

FIG. 3 illustrates an alternative arrangement of tiles 40 in a combustor wall structure 32, 34. The arrangement is generally similar to that of FIG. 2, and the same reference numerals are used for equivalent parts. However, instead of the tiles 40 being in overlapping relationship, they lie generally in the same plane.

The tiles 40 may be provided with sealing rails, which extend around part or all of the periphery of the tile. The rails extend from the tile plate portion towards the outer wall such that a discrete space 50 is defined between each tile 40 and the outer wall 38.

Figure 4:
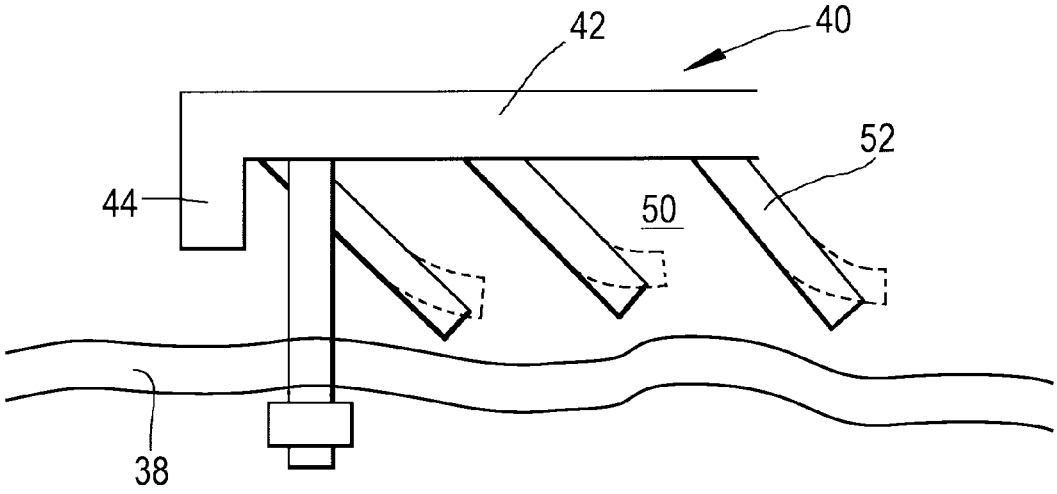

Referring to FIG. 4, each tile 40 includes a main body portion 42, which is shaped to conform to the general shape of the combustor wall structure 32, 34. At an axially directed edge of each tile, a sealing rail 44 extends from the main body portion 42 of the tile towards the outer wall 38 (which is shown with exaggerated irregularity). The sealing rails are intended to minimize the leakage of air from the space 50 around the edges of the tiles 40, and into the combustor 30. However, due to manufacturing tolerances, there is a small gap between the sealing rail 44 of each tile 40 and the outer wall 38. Adjacent sealing rails 44 of adjacent tiles 40 are located a small distance apart, resulting in an axial gap.

Each tile has an array of pedestals 52, which extend from the main body portion of the tile towards the outer wall 38 and which project from the main body portion of the tile a greater distance than the side rails.

The pedestals 52 are made of a material and have dimensions and arrangements, which allow them to deform or compress upon contact with the outer skin.

Figure 4A:
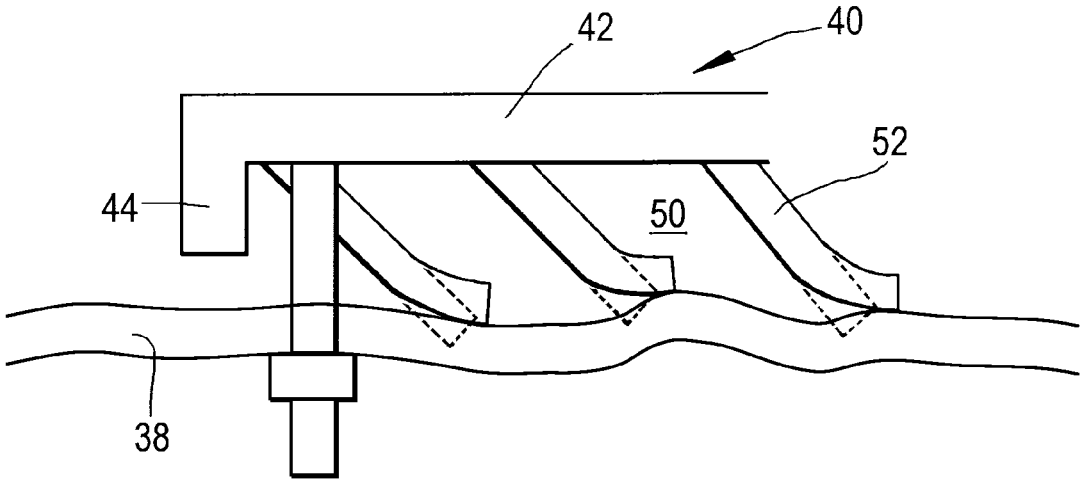
FIG. 4A is a diagrammatic cross-section of the wall element with pedestals deformed.

In the preferred embodiment, the pedestals are angled with respect to the surface of the outer wall. Where rails are provided, each pedestal protrudes slightly beyond the rail positions so that as the tile is secured to the cold wall via appropriate means each pedestal deflects, as shown in FIG. 4A. The amount of deflection will depend partly on the local position of the outer wall at the point of contact with the pedestal. The deflection may be via a pivot point close to the pedestal join with the wall element, or via a bending of the pedestal to the exemplary form shown by dashed lines in FIG. 4 and shown by solid lines in FIG. 4A. The deflection may be permanent in that the pedestal does not regain its initial form once the tile has been removed from the combustor following use.

Since each pedestal is designed to deflect contact with the outer wall is ensured allowing conduction from the tile to the outer wall through the pedestal. The elliptical shape of the contact point further increases the contact surface area. The length of the pedestal is also increased without having to further increase the volume beneath the tile or the distance between the tile and the outer wall. Thus, the combustor may, where it is desirable, be retro fitted without having to make significant changes to the combustor design. Additionally, cooling air is forced to pass between the pedestals rather than escaping under them.

One method of forming the tile can be through a process known as additive manufacture. In this process, the tile structure is formed by direct addition of media to the substrate. In the preferred method, a laser is used to melt the inner surface of the tile and a powder head scans over the surface to deposit a volume of powder into the melt pool. The laser traverses from the deposition location which allows the molten powder to cool forming a solidified, raised profile. By repeated deposition at the same location, higher deposits can be formed. If depositions overlap, it is possible to form the angled pedestals as shown. The powder used should have the same composition as that of the desired pedestal.

Figure 5:
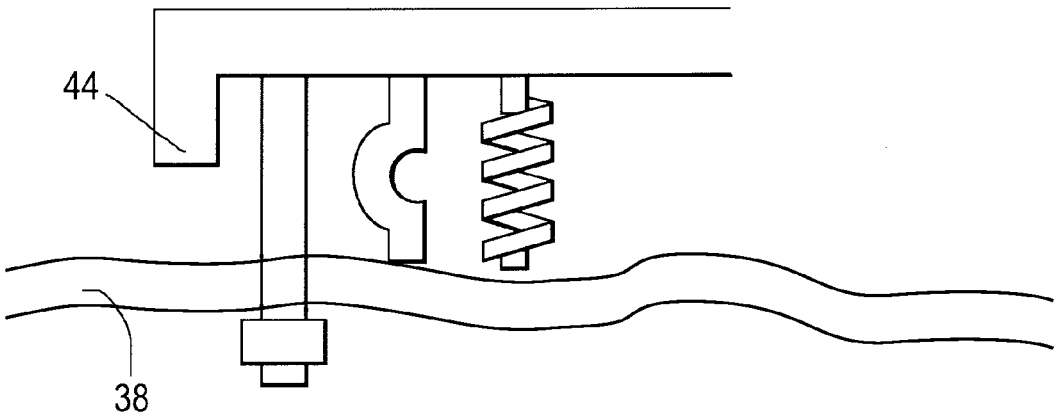
FIG. 5 depicts alternative cooling pedestal arrangements.

One of the benefits of forming the pedestal through a direct additive manufacture method is that other, more complex, forms of pedestal may be created. For example, the pedestals could have an omega or helical spring form, as shown in FIG. 5, that will further increase the length of each pedestal beyond that of a straight pedestal arranged perpendicular to the outer wall. Other flexible pedestal forms may be used as will be apparent to one of skill in the art.

What is claimed is:

1. A wall element connected with a gas turbine engine combustor wall that has an inner surface and an outer surface, the wall element and the inner surface defining a space therebetween, the wall element comprising deformable cooling pedestals extending into the space and which on contact with the inner surface deform against the inner surface of the combustor wall, wherein the wall element further comprises a body portion and elongate edge portions projecting from the body portion towards the inner surface of the combustor wall and wherein the deformable cooling pedestals are provided on the body portion which project in the same direction as and extend beyond the edge portions into the space.

2. A wall element according to claim 1, further comprising fastening elements for securing the wall element to the combustor wall.

3. A wall element according to claim 1, wherein the pedestals are at an angle other than 90° to the inner surface.

4. A wall element according to claim 1, wherein the pedestals have the form of a helical or omega spring.

5. A wall element according to claim 1, wherein the wall element is generally rectangular and further comprises axial and circumferential edges, the axial edges being generally oriented in an axial direction of the gas turbine engine combustor in use and the circumferential edges being generally oriented in a circumferential direction of the gas turbine engine combustor in use.

6. A wall element according to claim 5, wherein seal means are provided on or near the axial edges of the wall element.

7. A wall element according to claim 5, wherein seal means are provided on or near the circumferential edges of the wall element.

8. A wall element according to claim 1, the wall element being for use in a back plate region of a combustor, the wall element being generally sector shaped, including spaced radial edges and spaced circumferential edges.

9. A gas turbine combustor wall structure comprising:

a combustor wall; and a plurality of discrete tiles attached to the combustor wall on the combustion side, there being a space formed between each discrete tile and the combustor wall;

each of the discrete tiles provided with deformable cooling pedestals extending into the space;

the cooling pedestals deforming laterally when contacting the combustor wall, wherein discrete tile edges overlap.

10. A gas turbine engine combustion chamber comprising:

a combustor wall with discrete tiles attached to an inner surface of the combustor wall, the discrete tiles and the inner surface defining a space therebetween, the discrete tiles provided with deformable cooling pedestals extending into the space and which on contact with the inner surface of the combustor wall deform against the inner surface.

* * * * *